United States Patent [19]

Stoehr

[11] 4,235,384

[45] Nov. 25, 1980

[54] APPARATUS FOR PROVIDING TAPED COILS OF SHEET MATERIAL

[75] Inventor: Herbert M. Stoehr, New Berlin, Wis.

[73] Assignee: Artos Engineering Company, New Berlin, Wis.

[21] Appl. No.: 930,888

[22] Filed: Aug. 4, 1978

[51] Int. Cl.[3] ..... B21C 47/00

[52] U.S. Cl. ..... 72/148; 72/250

[58] Field of Search ..... 72/146, 148, 169, 183, 72/250; 29/820

[56] References Cited

U.S. PATENT DOCUMENTS

| | | | |
|---|---|---|---|
| 1,462,411 | 7/1923 | Johnson | 72/146 |
| 1,654,651 | 1/1928 | Johnson | 72/148 |
| 2,155,879 | 4/1939 | Washburn et al. | 72/146 X |
| 2,161,076 | 6/1939 | Morgan | 72/146 |
| 2,325,559 | 7/1943 | Washam | 72/148 |
| 2,920,838 | 1/1960 | Priestley | 72/146 |
| 2,963,237 | 12/1960 | Yaeger | 72/148 |

*Primary Examiner*—Leon Gilden

*Attorney, Agent, or Firm*—James E. Nilles

[57] ABSTRACT

Apparatus for providing taped coils of sheet material comprises an intermittently operable feed roll mechanism for feeding a continuous web of sheet material through an intermittently operable web shear mechanism to an intermittently operable coiling mechanism on which coils are wound and which has an intermittently operable adhesive tape dispensing and applying mechanism associated therewith to tape the wound coil after web severance. The coiling mechanism comprises a rotatable expandable/retractable mandrel upon which the sheet material is wound into a coil while the mandrel is expanded; a pair of hold-down plates and a plurality of spaced apart web guide plates disposed around the periphery of the mandrel and adjustably positionable between winding and release positions to initially direct the severed leading edge of the incoming web around the expanded mandrel at the onset of coil winding; a plurality of spaced apart cage rollers disposed around the periphery of the mandrel and adjustably positionable between winding and release positions to press against the coil as it is being wound and thereby ensure tightness; a mandrel support mechanism to support the mandrel during winding; and an ejector mechanism for axially shifting a taped coil off the retracted mandrel when the mandrel stops rotating and while the hold-down plates, the web guide plates, and the cage rollers are located radially away from the mandrel and coil thereon in the release position. Control means are provided to operate the apparatus mechanisms and components thereof in timed relationship and enable sequential production of taped coils.

15 Claims, 16 Drawing Figures

L1
L2
L3
DS
MC
T1
T2
T3
M
CPT
OL1
OL2
LS1
1TBS
2TBS
LS3
LS4
STOP
1PB
3TBS
LS2
1SS
JOG
RUN
MAIN START
MR
MR
JOG
3PB
1S
TDR
C1
1CR
1CR
TS1
2PB
1CR
2S
3S
TS2
4S
TS3
5S
4PB
TS4
6S
SE
MU
CCR
CCR
7S
CCR
C1
C2
LS6
8S

APPARATUS FOR PROVIDING TAPED COILS OF SHEET MATERIAL

BACKGROUND OF THE INVENTION

1. Field of Use

This invention relates generally to apparatus for providing taped coils of sheet material and, in particular, to a coiling mechanism for such apparatus.

2. Description of the Prior Art

Large heavy coils of sheet material such as steel, aluminum, or the like, supplied from the mill sometimes need to be slit and rewound into smaller and lighter taped coils more suitable for particular manufacturing operations or retail sale. Apparatus already exists for this purpose and U.S. Pat. No. 3,832,876 discloses an example. In that patent, intermittently operated feed rolls feed a continuous strip of sheet material past an intermittently rotated cut-off and end-bending shaft cooperating with a stationary cut-off bar and a stationary wedge-shaped end-bending bar to sever, reversely bend the severed end, and feed the same to a coiling drum having thereon circumferentially spaced strip end catch bars, one of which grasps the bent end of the severed strip and couples it to the periphery of the rotating coiling drum as after a predetermined length of the strip has been measured off by a strip length measuring unit. During coiling, a crescent-shaped pivoted pressure arm prevents rumpling of the strip being wound thereon. While the severed strip is being completely wound on the coiling drum, a taping device descends and deposits a band of adhesive tape around the circumference of the coil on the drum to prevent it from unwinding. The intermittent motions of the rotary cutting and bending shaft, as well as that of the taping unit, are controlled and actuated by the pistons of fluid pressure cylinders which also regulate the starting and stopping of the strip feeding rolls. When the tape has been deposited, as far as is desired, around the periphery of the coiling drum, the tape roll is prevented from rotating by a braking device while the taping device is raised, thereby causing the thus-taut tape to be severed by a knife attached to the taping device. A coil ejector ring is then pushed against the inner end of the coil so as to eject it from the coiling drum.

In the aforedescribed apparatus, the leading edge of the oncoming severed strip of material needs to be bent so that it can engage the catch bars on the coiling drum. Such bending results in a certain amount of material wastage in the coil being wound and also requires relatively complex severing, bending, and coiling mechanisms to sever the web, make the bend, and subsequently cause the bent edge to engage to the coiling drum to enable coiling. In addition, the pressure arm acts on only one side of the coil as it is being wound and, therefore, does not ensure a tightly wound coil. Furthermore, since the coiling drum is of fixed diameter, frictional engagement between the coil and the coiling drum needs to be overcome by the ejector ring as the coil is ejected from the drum.

SUMMARY OF THE INVENTION

Apparatus in accordance with the invention for providing taped coils of sheet material comprises an intermittently operable feed roll mechanism for feeding a continuous web of sheet material through an intermittently operable web cut-off shear mechanism to an intermittently operable coiling mechanism on which coils are wound and which has an intermittently operable adhesive tape dispensing and applying mechanism associated therewith to tape the wound coil after web severance. The coiling mechanism comprises a rotatable expandable/retractable split mandrel upon which the sheet material is wound into a coil while the mandrel is expanded; web guide means including a pair of relatively movable hold-down plates and a plurality of spaced apart curved web guide plates disposed around the periphery of the mandrel and adjustably positionable between winding and release positions to initially direct the severed leading edge of the incoming web around the expanded mandrel at the onset of coil winding; a plurality of spaced apart cage rollers disposed around the periphery of the mandrel and adjustably positionable between winding and release positions to press against the coil as it is being wound and thereby ensure tightness; a mandrel support mechanism to support the mandrel during winding; and an ejector mechanism for axially shifting a taped coil off the retracted mandrel when the mandrel stops rotating and while the hold-down plates, the web guide plates and the cage rollers are located radially away from the mandrel and coil thereon in the release position. Control means are provided to operate the apparatus mechanisms and components thereof in timed relationship and enable sequential production of taped coils.

The split mandrel comprises a rotatable hollow main shaft on which two semi-cylindrical hollow component sections are mounted, which sections are relatively movable toward and away from each other at one end by means of a pneumatically operated reciprocably movable rod extending through the main shaft to cause the mandrel to assume a generally cylindrical shape when expanded and to assume a generally conical shape when retracted to facilitate coil ejection axially therefrom.

The web guide means includes a pair of relatively movable hold-down plates which are movable between one position wherein they cooperate to define a funnel-shaped entryway for guiding the severed leading edge of the web toward the mandrel and another position wherein the plates are clear of the coil being formed on the mandrel.

The web guide means further include the plurality of spaced apart curved web guide plates which are mounted on the same support members as the cage rolls, which support members are movable between a winding position near the mandrel and a release position away from the mandrel by means of pneumatic cylinders. One cage roll and one guide plate on one support member are also spring-biased toward the mandrel. One cage roll and one guide plate on the other support member are also independently actuatable by a separate pneumatic cylinder toward and away from the mandrel.

The apparatus and the coiling mechanism in accordance with the invention offer several advantages over the prior art. For example, use of a split mandrel having relatively movable component sections enables the cage rollers to cause a tightly wound coil to be produced while the mandrel is expanded but then enables the finished taped coil to be easily removed from the mandrel by the ejector mechanism when the mandrel is contracted. Furthermore, the guide means enables the cut but unbent leading edge of the incoming web to engage the mandrel to permit coil winding to commence but move out of the way as coil winding proceeds, thereby eliminating the need for special cutting and bending shears and thereby reducing material wastage. The rollers ensure a tightly wound coil but also move out of the way when winding is finished to facilitate removal of the coil from the mandrel. Apparatus in accordance with the invention enables high speed winding of coils, since some prior art operational steps are eliminated. Furthermore, since the apparatus is simpler than the prior art, the possibilities of jamming and breakdown are reduced. Other objects and advantages of the invention will hereinafter appear.

DESCRIPTION OF A PREFERRED EMBODIMENT

General Arrangement

Figure 1:
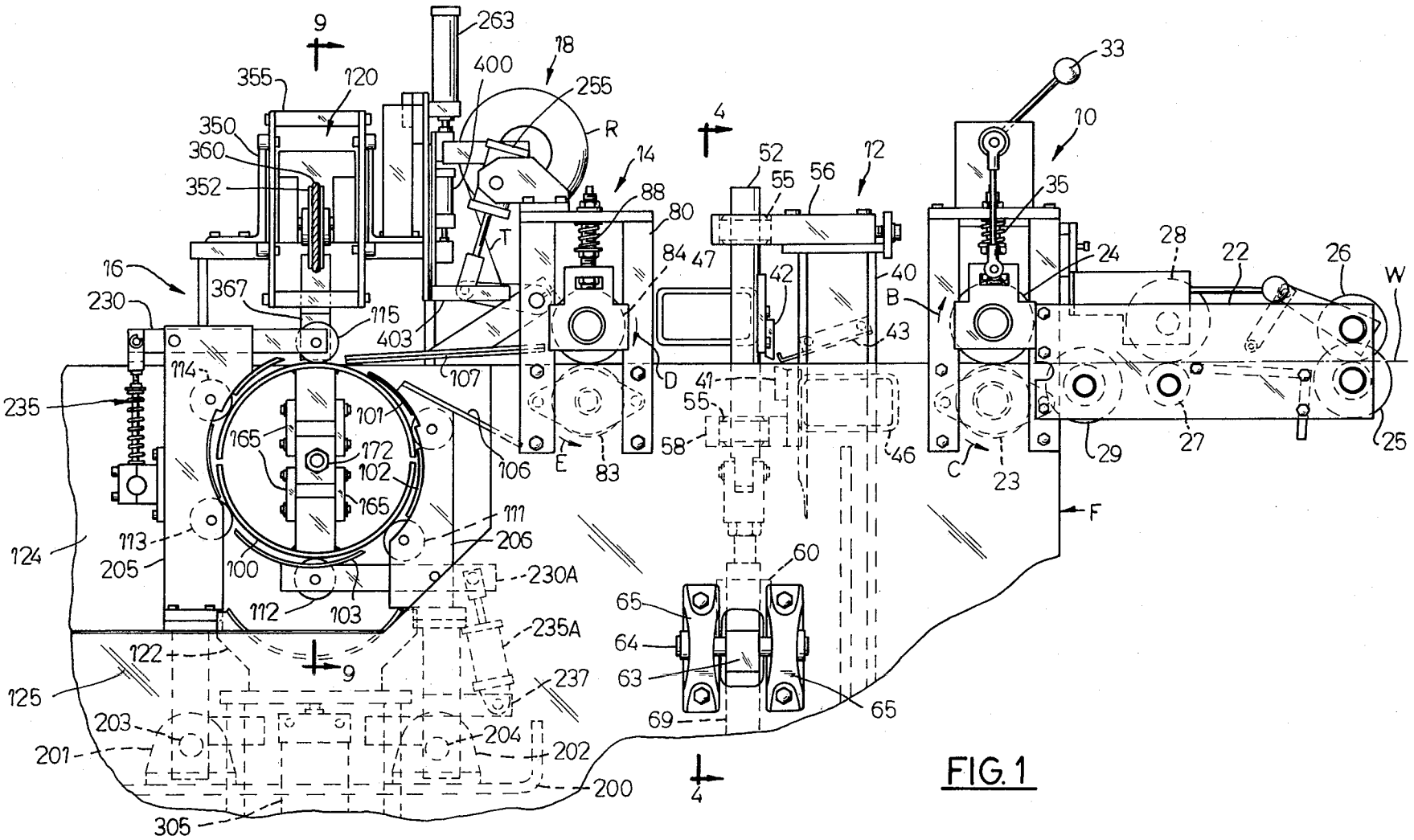
FIG. 1 is a side elevational view of apparatus in accordance with the invention.
Figure 2:
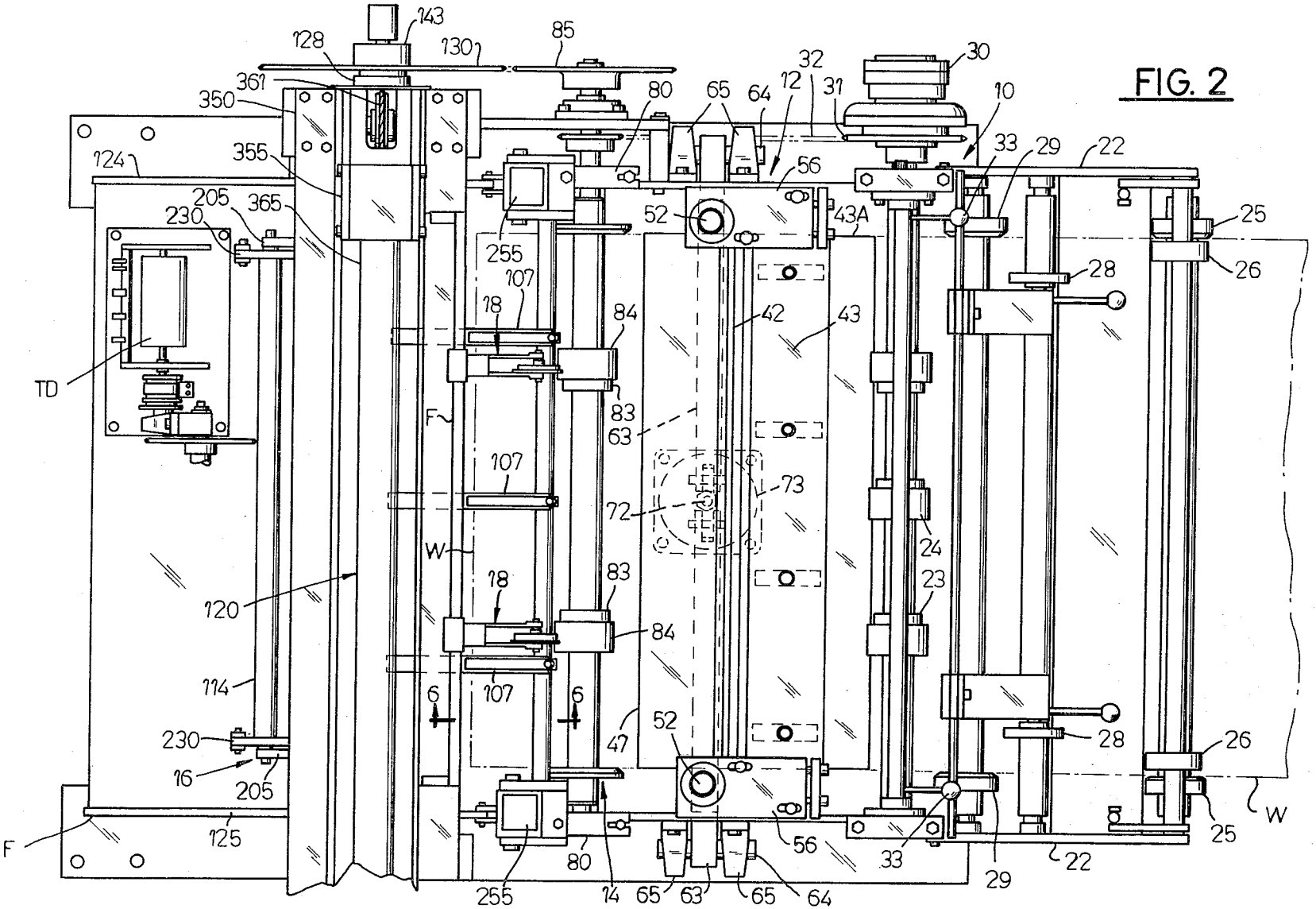
FIG. 2 is a top plan view of the apparatus shown in FIG. 1.
Figure 3:
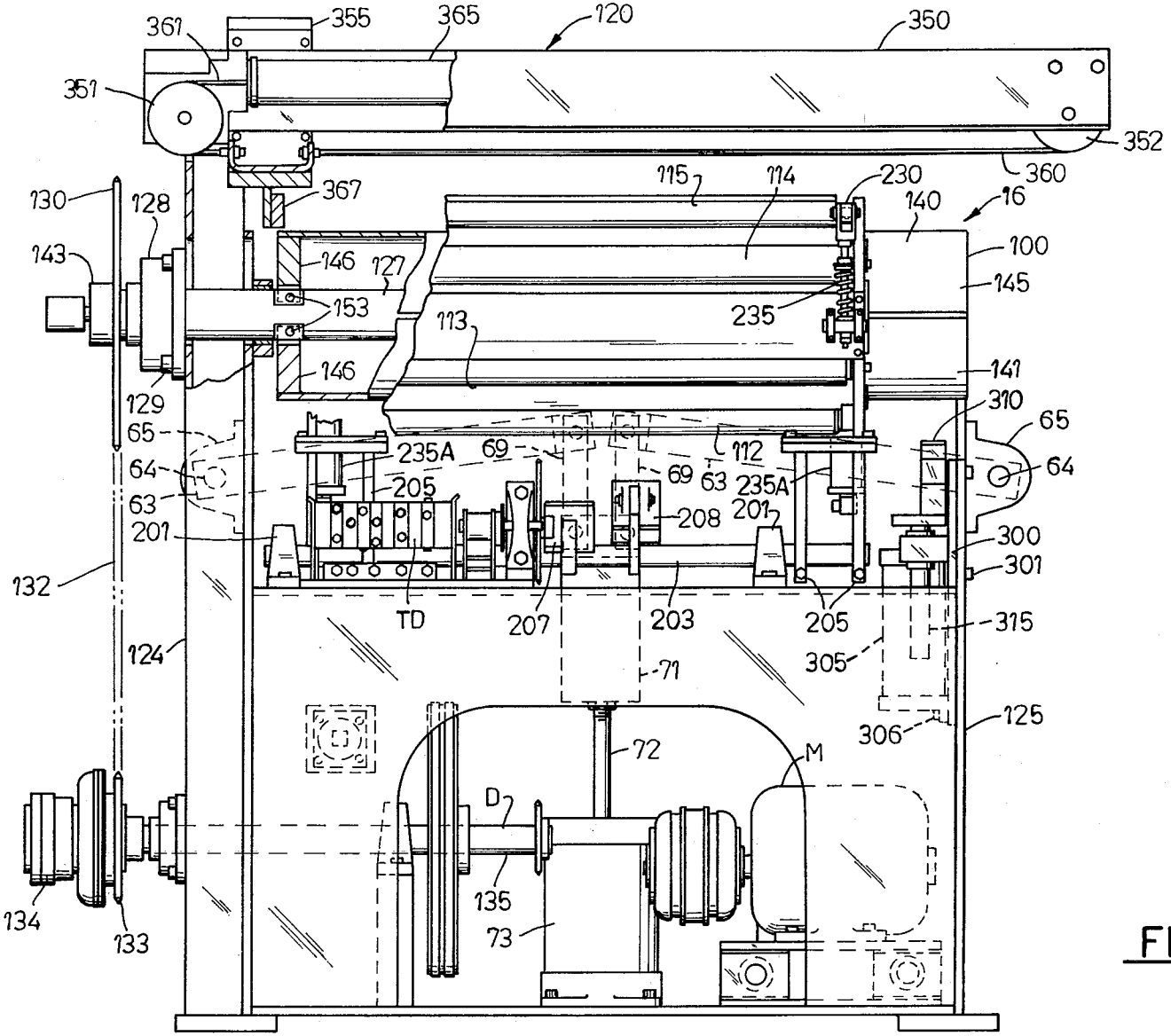
FIG. 3 is an elevational view of the left end of the apparatus shown in FIGS. 1 and 2.

FIGS. 1, 2, and 3 show apparatus in accordance with the invention for forming a taped coil C from a continuous web W of sheet material which is supplied from a source such as a large roll (not shown). The apparatus generally comprises a rigid supporting framework F on which are mounted intermittently operable mechanisms including: a first web feed mechanism 10, a web shear mechanism 12, a second web feed mechanism 14, a coiling mechanism 16, and an adhesive tape dispensing and applying mechanism 18.

First web feed mechanism 10 draws web W from the source and advances it in the direction of arrow A through shear mechanism 12 and through second web feed mechanism 14 into the coiling mechanism 16 wherein the coil C is wound, whereupon the web W is severed by shear 12, the coil C is taped by mechanism 18 and then ejected from the coiling mechanism 16.

The First Web Feed Mechanism

Figure 15:
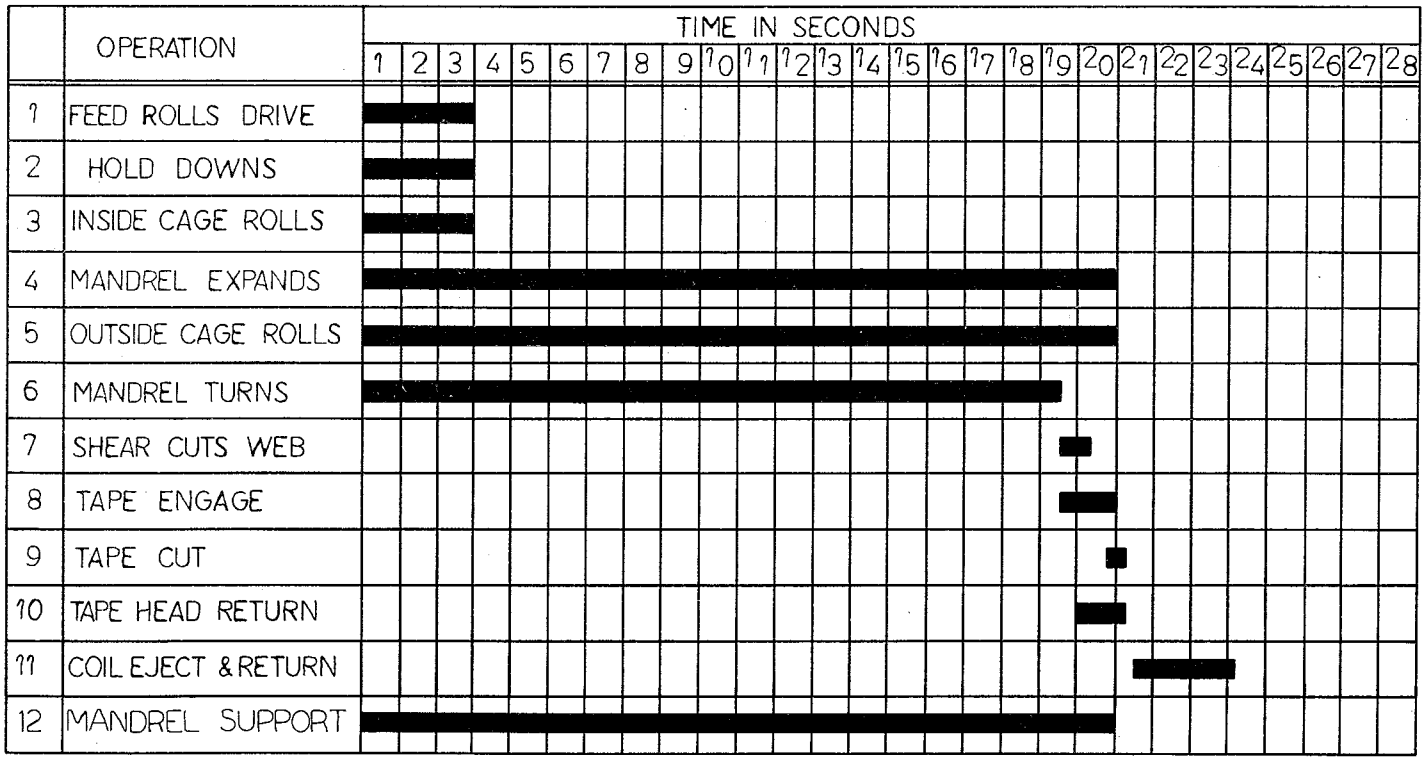
FIG. 15 is a chart depicting the timed operating sequences of the mechanisms and components in the apparatus in accordance with the present invention.
Figure 16:
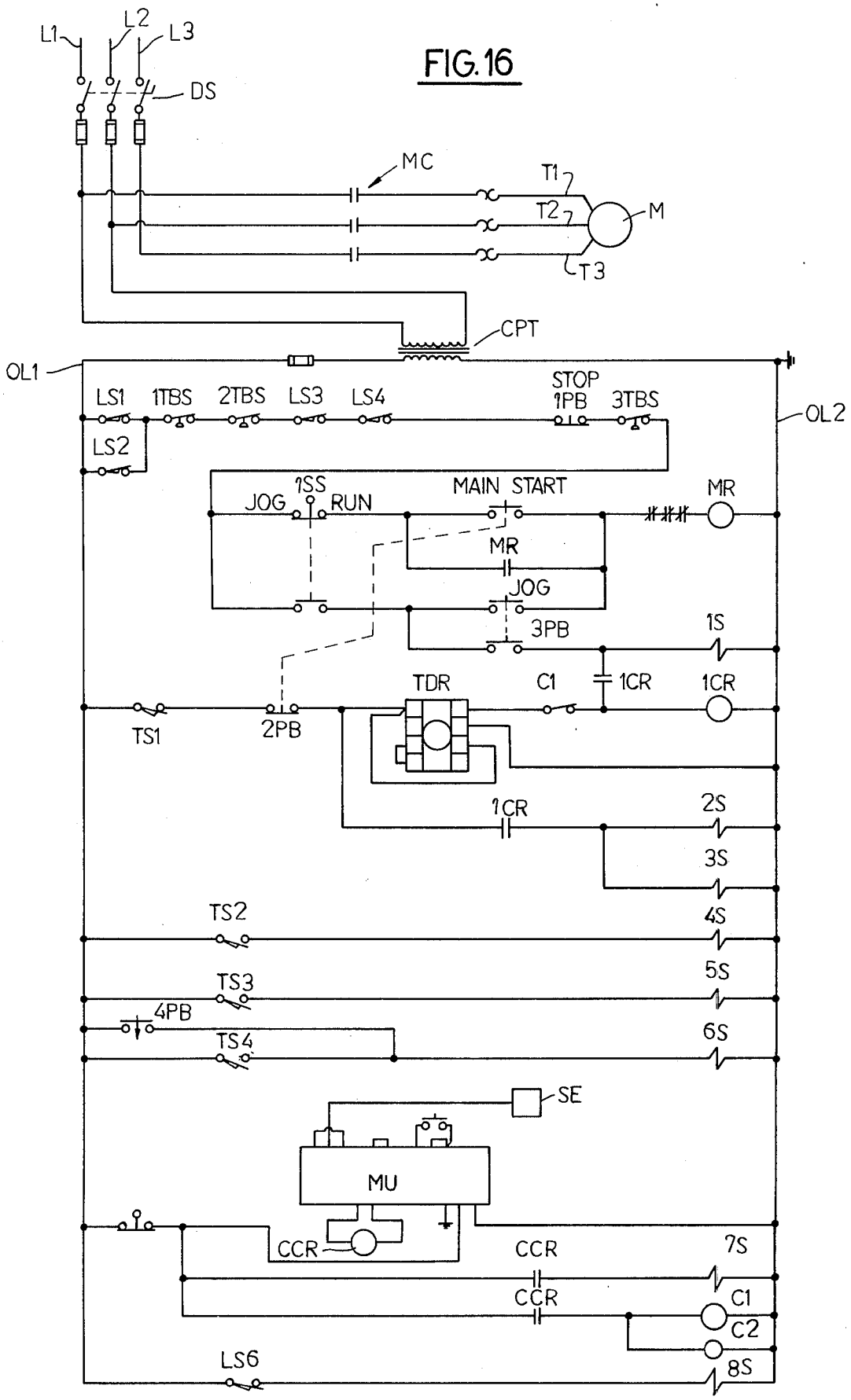
FIG. 16 is an electrical circuit diagram of a portion of the control system for apparatus in accordance with the invention.

As FIGS. 1, 2, 3, and 16 show, first web feed mechanism 10 is located at the web input end of the apparatus and comprises a pair of laterally spaced apart rigid support plates 22 connected to framework F and between which a pair of driven feed rolls 23 and 24 are rotatably mounted. First web feed mechanism 10 also includes auxiliary rolls such as 25, 26, 27, 28, and 29 which smooth and guide web W prior to its entry between the driven feed rolls 23 and 24. The feed rolls 23 and 24 rotate in the direction of the arrows B and C and are driven intermittently for a predetermined interval of time (such as three seconds, as shown in FIG. 15) in order to provide a predetermined length of web W for coiling. The lower feed roll 23 is connectable for driving through an intermittently operable clutch 30 (FIGS. 2 and 16) to sprocket 31 which is connected to and driven by a chain 32. Chain 32 is ultimately connected to a drive shaft D of an electric motor M (FIGS. 3 and 16). First web feed mechanism 10 also comprises a pair of manually operable release levers 33 to allow separation of the feed rolls 23 and 24 for initial insertion of web W therebetween and further comprises a helical compression spring assembly 35 for biasing the upper feed roll 23 toward the lower feed roll 24 to ensure positive web drive.

The Web Shear Mechanism

Figure 5:
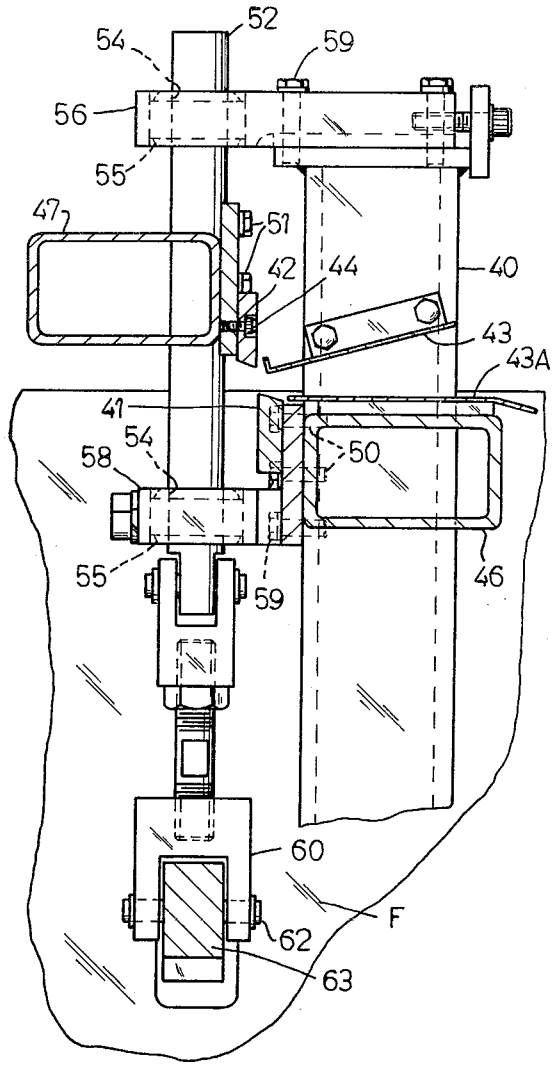
FIG. 5 is an enlarged view partly in cross section of the shear mechanism taken on line 5—5 of FIG. 4.
Figure 4:
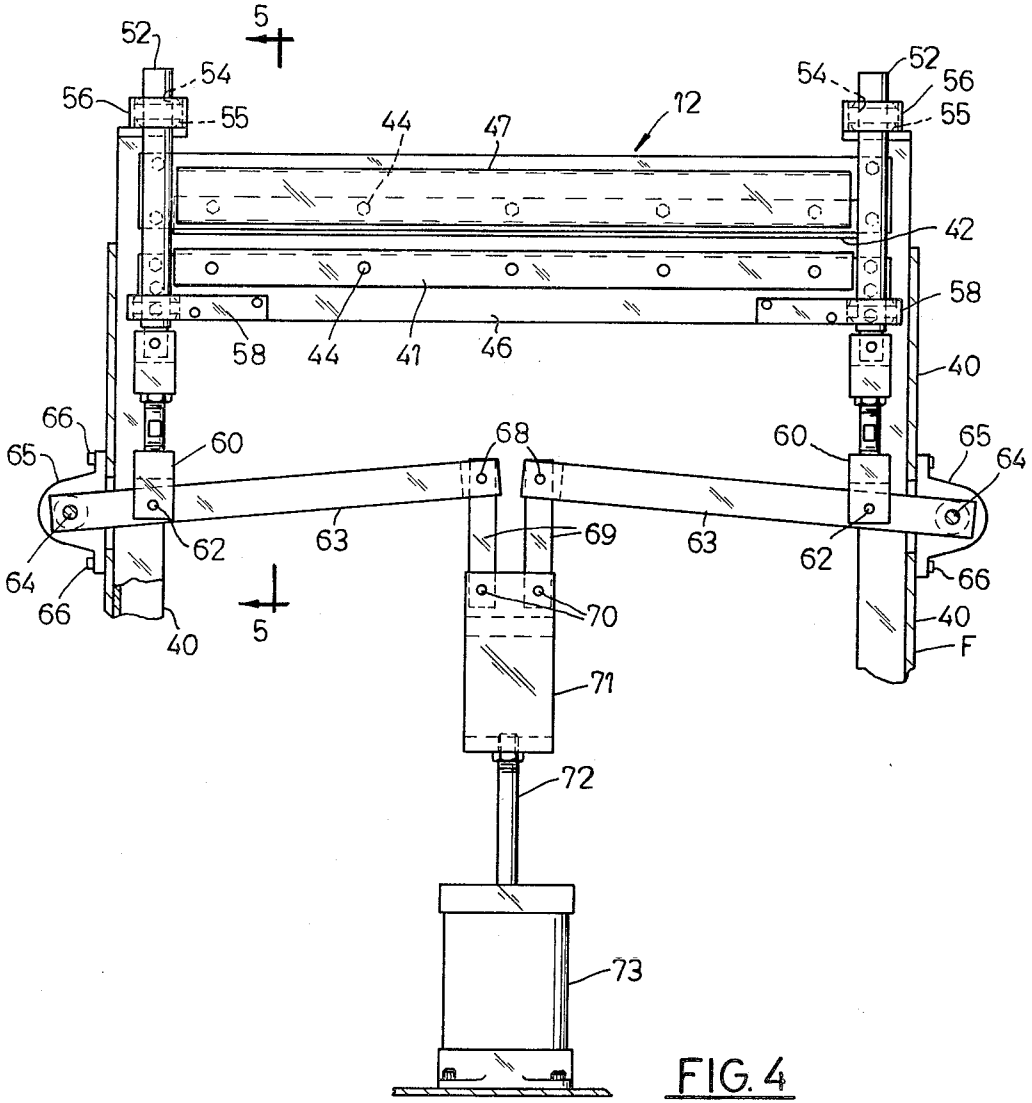
FIG. 4 is a view of the shear mechanism of the apparatus taken on line 4—4 of FIG. 1.
Figure 8:
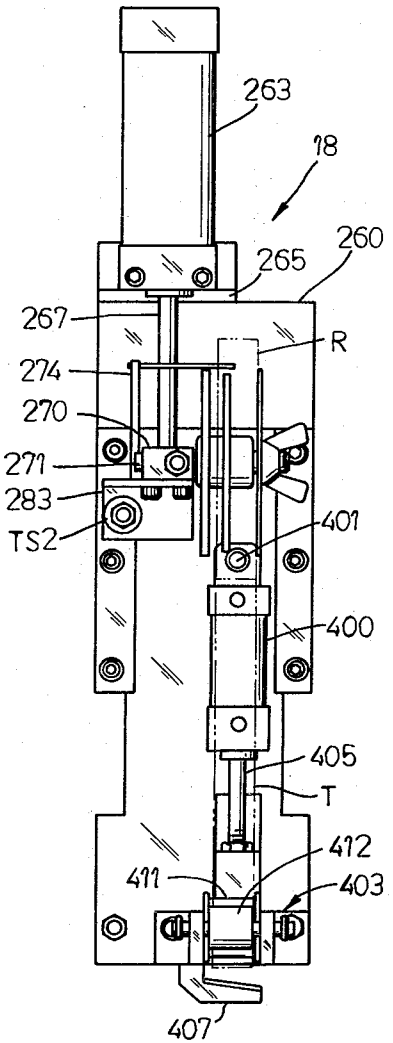
FIG. 8 is a view taken on line 8—8 of FIG. 7.
Figure 7:
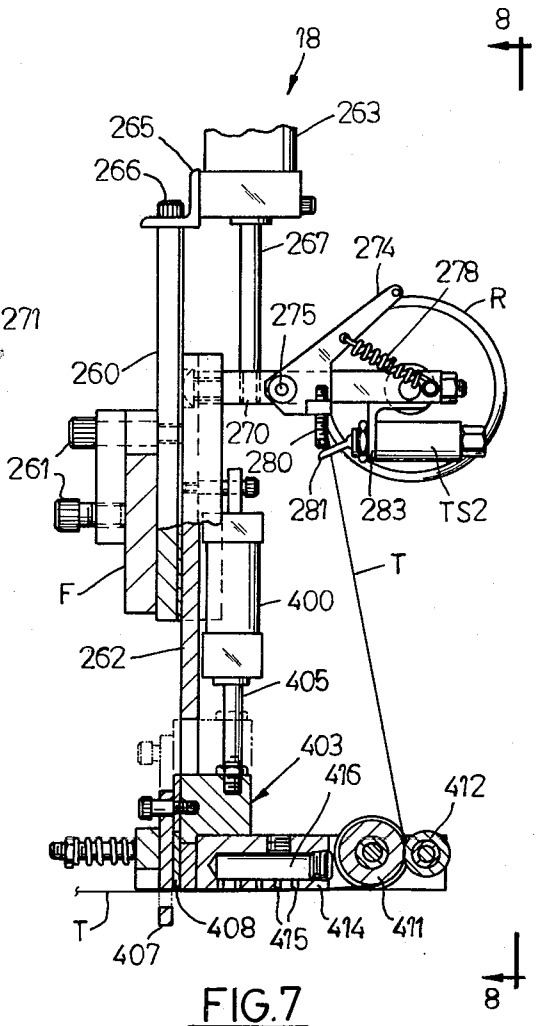
FIG. 7 is a view partly in cross section of the mechanism shown in FIG. 6 but showing the mechanism in a lowered operating position.
Figure 6:
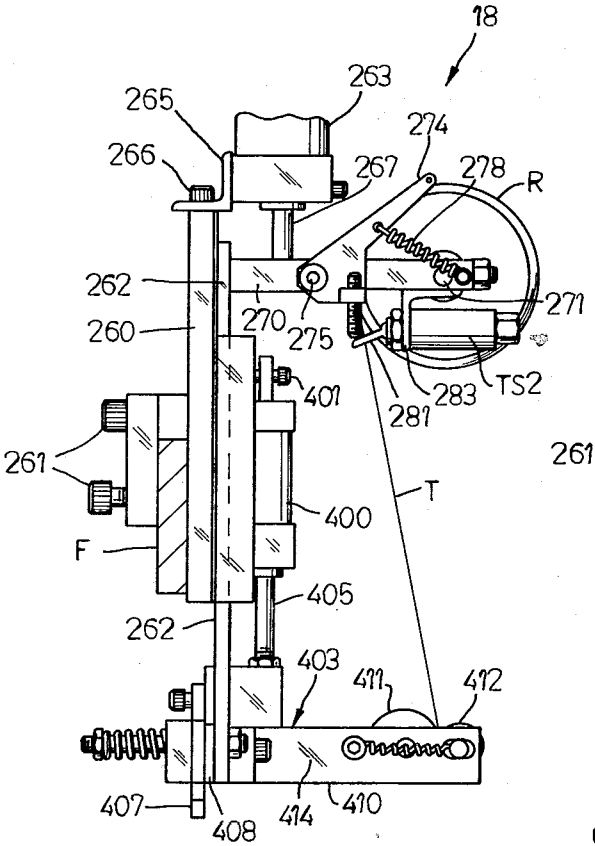
FIG. 6 is an enlarged view of the tape dispensing and applying mechanism taken on line 6—6 of FIG. 2 and showing the mechanism in one operating position.

As FIGS. 1, 2, 3, 4, and 5 show, web shear mechanism 12 is located between the web feed mechanisms 10 and 14, downstream of the former and upstream of the latter, and comprises a pair of laterally spaced apart vertically disposed rigid side supports 40 of U-shaped cross section which are connected to framework F. Shear mechanism 12 comprises elongated horizontally disposed lower stationary and upper movable shear blades 41 and 42, respectively, which are rigidly secured by bolts 44 to elongated horizontally disposed stationary and movable blade support members 46 and 47, respectively, which are in the form of box guides. Lower stationary blade support 46 is rigidly secured by bolts 50 to and between the side supports 40. Upper movable blade support 47 is rigidly secured by bolts 51 to a pair of laterally spaced apart vertically disposed rods 52. Each rod 52 is slideably mounted for reciprocating vertical movement in bearings 55 mounted in bores 54 of upper and lower rod support brackets 56 and 58, respectively, which are rigidly connected as by bolts 59 to a side support 40. Each rod 52 has a clevis 60 connected to its lower end and each clevis 60 is pivotally connected by a clevis pin 62 to a lever 63. One end of lever 63 is pivotally connected by a pin 64 to a support bracket 65 which is secured by bolts 66 to a side plate 40. The other end of lever 63 is pivotably connected by a pin 68 to a link 69 which, in turn, is pivotally connected by a link pin 70 to a link head 71. Link head 71 is connected to the piston rod 72 of a pneumatic cylinder 73 which, when retracted, causes the shear mechanism 12 to close and cut the web W and, when extended, causes the shear to open. FIGS. 4 and 5 show shear mechanism 12 open.

The Second Web Feed Mechanism

As FIGS. 1, 2, 3, and 16 show, second web feed mechanism 14 is located between shear mechanism 12 and coiling mechanism 16, downstream of the former and upstream of the latter, and comprises a pair of laterally spaced apart rigid support members 80 connected to framework F and between which a pair of driven feed rolls 83 and 84 are rotatably mounted. The feed rolls 83 and 84 rotate in the direction of the arrows D and E and are driven intermittently for a predetermined interval of time (such as three seconds, as shown in FIG. 15) in order to assist the first web feed mechanism 10 in providing a predetermined length of web W for coiling. The second web feed mechanism 14 also serves to control the travel of the tail of the coil after web severance by shear mechanism 12 and during operation of the tape dispensing and applying mechanism 18. The lower feed roll 83 is connectable for driving by means of a sprocket 85 thereon which is connected to and driven by a chain 87. Chain 87 is ultimately connected to drive shaft D of electric motor M. A helical compression spring roller biasing assembly 88 is provided for biasing upper roll 84 toward lower feed roll 83 to ensure positive web drive.

The Coiling Mechanism

FIGS. 1, 2, 3, 9, 10, 11, 12, 13, and 14 show the coiling mechanism 16 which comprises: a rotatable expandable/retractable split mandrel 100 on which coil C is wound while the mandrel is expanded; guide means, including a plurality of adjustably positionable curved guide plates 101, 102, 103, 104 and 105 disposed around the periphery of the mandrel and a pair of relatively movable hold-down plates 106 and 107, to initially direct the severed leading edge of the incoming web from the second web feed mechanism 14 around the mandrel; a plurality of adjustably positionable cage rollers 110, 111, 112, 113, 114, and 115 disposed around the periphery of the mandrel to press against the coil C as the latter is being wound to ensure tightness; an ejector mechanism 120 for axially shifting a wound and taped coil C off the mandrel when the mandrel stops rotating and is retracted and the curved guide plates and cage rollers are in the release positions; and a mandrel support mechanism 122 which operates to support the mandrel and the coil thereon during winding.

Coiling mechanism 16 comprises a pair of laterally spaced apart rigid side support plates 124 and 125. Mandrel 100 comprises a hollow cylindrical main shaft 127 having a bore 126 axially therethrough which is journalled for rotation in and supported by a large main bearing 128 which is rigidly secured to support plate 124 by bolts 129. Main shaft 127 has a driven sprocket 130 secured to one end thereof by bolts 131 and this sprocket is driven by a drive chain 132 which is connected thereto and to a drive sprocket 133. Drive sprocket 133 is connectable by means of a mandrel clutch 134 to a drive shaft 135 which, in turn, is driven by the drive shaft D of motor M.

Mandrel 100 has two component sections 140 and 141 which are physically supported on and rotatable with main shaft 127 and which are radially movable with respect to main shaft 127 between an outward expanded position and an inward retracted position by means of a mandrel control pneumatic cylinder 143. Since component sections 140 and 141 are identical in construction and mode of operation, only section 140 is hereinafter described in detail. Section 140 comprises a rigid outer shell member 145 in the shape of half a hollow cylinder which is provided with inwardly extending rigid support members 146 and 148 which are welded as at 149 at or near opposite ends thereof.

Figure 9:
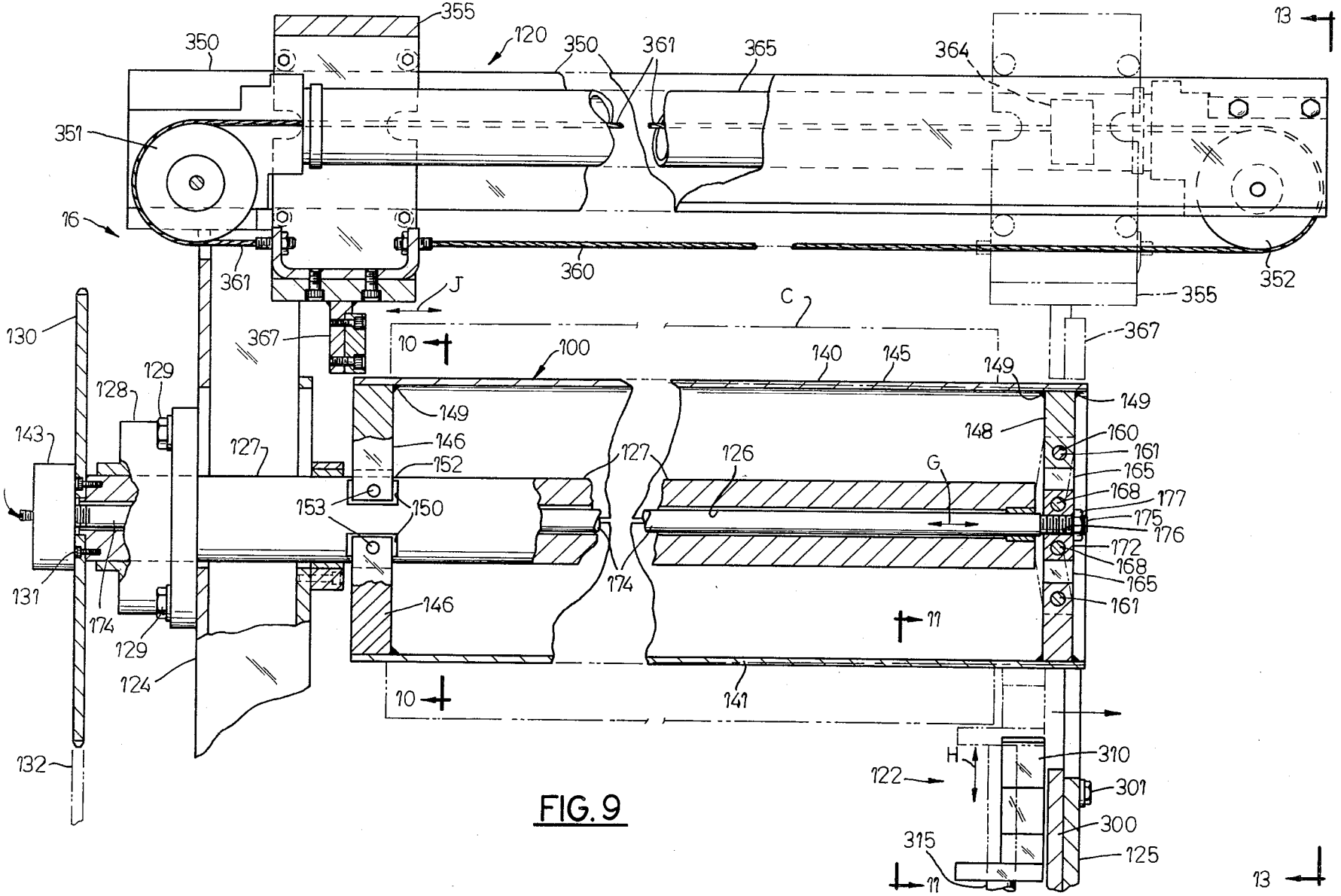
FIG. 9 is an enlarged view partly in cross section of the coiling mechanism and taken on line 9—9 of FIG. 1.
Figure 11:
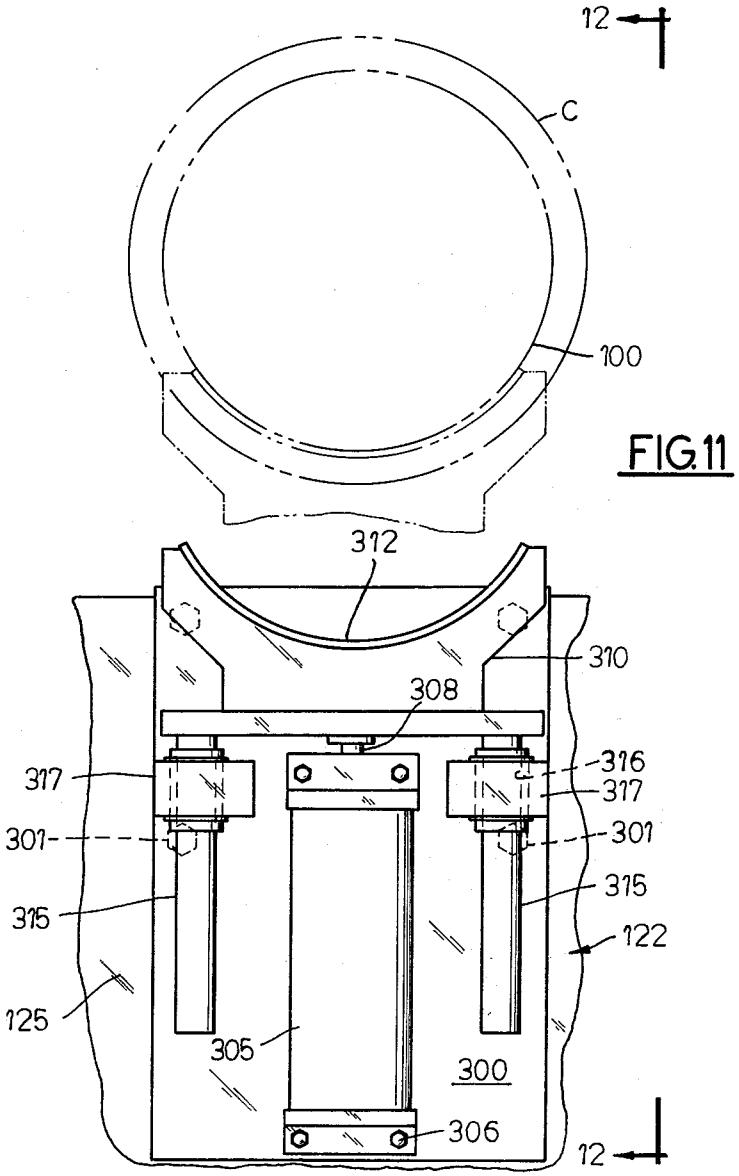
FIG. 11 is an enlarged elevational view of the roll support of the coiling mechanism taken on line 11—11 of FIG. 9.
Figure 10:
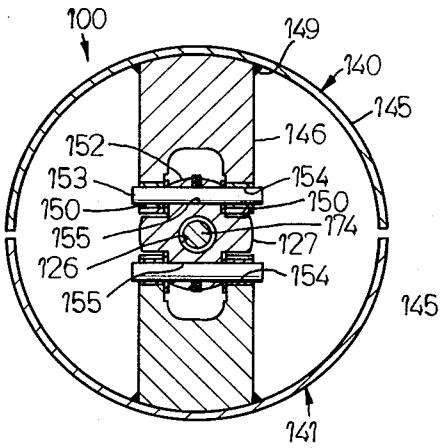
FIG. 10 is a cross sectional view of the mandrel of the coiling mechanism taken on line 10—10 of FIG. 9.

As FIGS. 9 and 10 show, the inner end of innermost support member 146 is bifurcated and adapted for insertion into a pair of spaced apart recesses 150 which are formed in the surface of the main shaft 127 and which define an abutment 152 therebetween. A pivot pin 153 extends through holes 154 in the bifurcations in the support member 146 and through a hole 155 in the abutment 152 and pivotally connects the support member 146 to the main shaft 127.

Figure 13:
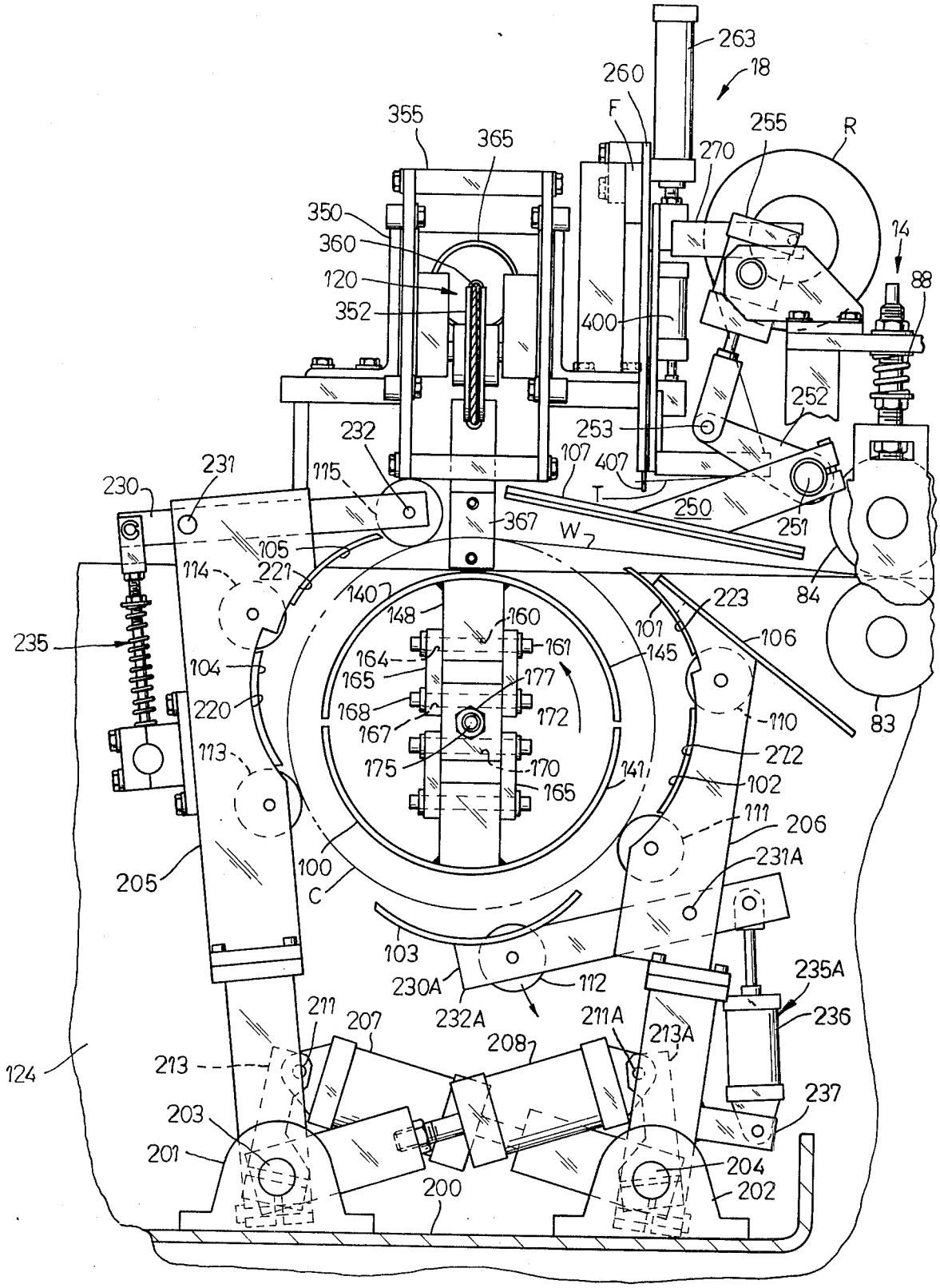
FIG. 13 is an end elevational view of the coiling mechanism taken on line 13—13 of FIG. 9 and showing the components thereof in one operating position.
Figure 14:
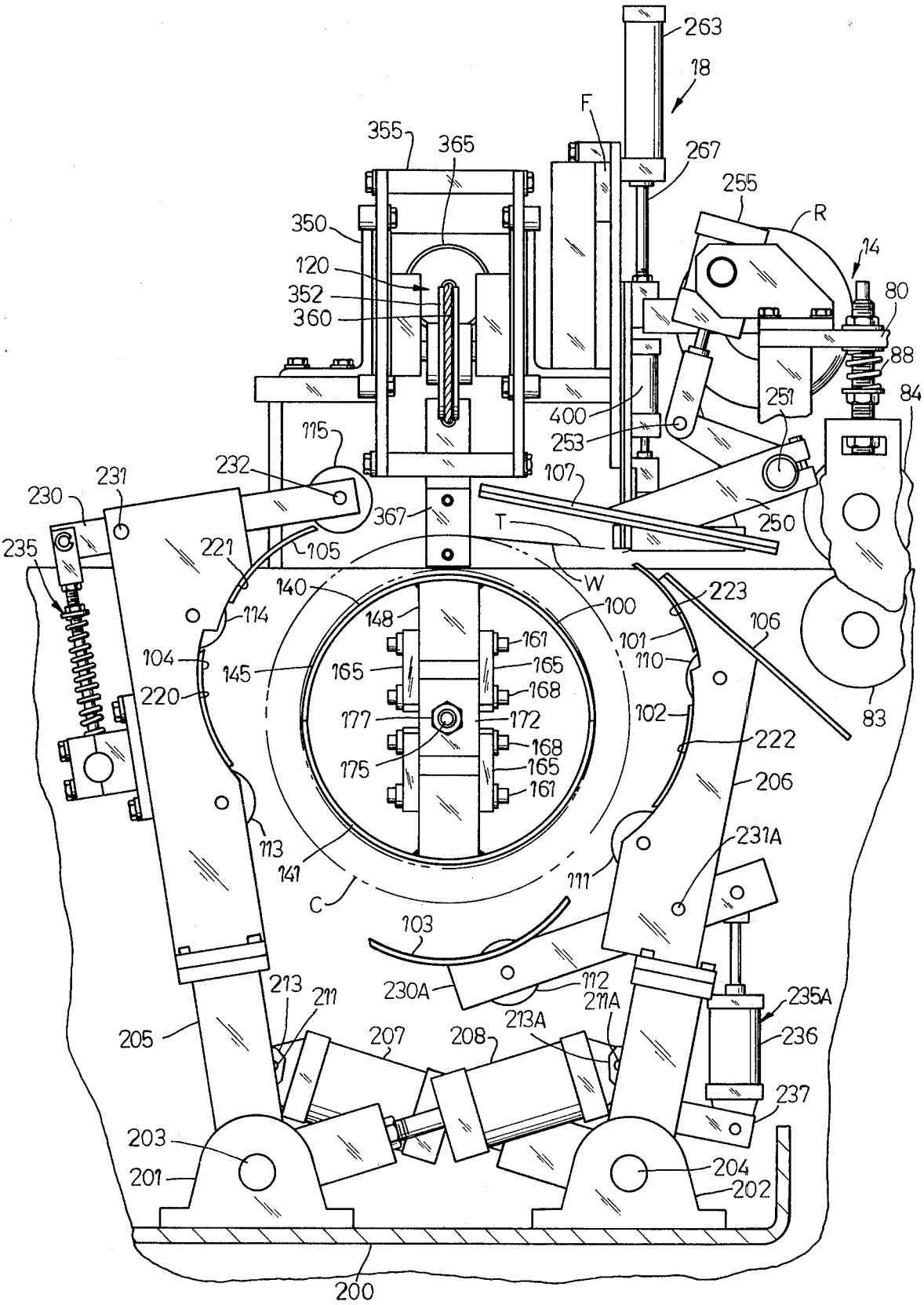
FIG. 14 is a view similar to FIG. 13 but showing the components in another operating position.

As FIGS. 9 and 13 show, the inner end of outermost support member 148 has a hole 160 therethrough for receiving a pivot pin 161. The end of pivot pin 161 extends through a hole 164 in a pivot link 165 and pivotally connects the latter thereto. Pivot link 165 also has a hole 167 for receiving the end of a pivot pin 168 which extends through a hole 170 in a block 172. Block 172 is rigidly secured to the end of an axially movable operating rod 174 which extends through the bore 126 of main shaft 127 of mandrel 100. In particular, one end of rod 174 is of smaller diameter and threaded as at 175 and extends through a bore 176 in block 172 and a nut 177 rigidly secures the block to the rod. Rod 174 is reciprocably movable as indicated by arrow G in FIG. 9 by means of a pneumatic cylinder 143, shown in FIG. 9, to cause expansion and retraction of mandrel 100. FIGS. 1, 9, and 10 show mandrel 100 expanded as during coil winding, and FIG. 14 shows it retracted as during wound coil ejection. It is to be noted, with respect to FIG. 9, that when rod 174 is moved rightward, the right end of mandrel 100 assumes the expanded condition or position shown. When rod 174 is moved leftward, the right end of mandrel 100 assumes the retracted condition or position, but the left end of the mandrel sections 140 and 141 merely pivot and do not substantially retract. In other words, when mandrel 100 is extended, it defines a cylinder of predetermined diameter but when it is retracted, it defines a cone having a small end of less than the aforesaid predetermined diameter, thereby enabling a coil C to be easily shifted axially from the mandrel by means of the ejector mechanism 120.

FIGS. 1, 13, and 14 show the construction and arrangement of the guide means and cage rollers and illustrate their positions during various operating stages of the coiling mechanism 16. FIG. 1 depicts the initial stage of a coil winding operation wherein the leading edge of the web W is being fed into the coiling mechanism 16 and is being directed around the mandrel 100 by the guide plates and the cage rollers. FIG. 13 depicts an intermediate stage in a coil winding operation wherein the guide plate 101–105 and the cage rollers 110, 112, and 114 have been moved radially away from the coil being wound. FIG. 14 depicts the final stage in the coil winding operation wherein all guide plates and all cage rollers have been moved radially outwardly away from the coil and into the release positions so that the finished coil is free to be ejected from the coiling mechanism 16.

The side support plates 124 and 125 of coiling mechanism 16 mechanically support a base plate 200 which is rigidly secured therebetween as by welding. Base plate 200 supports left hand and right hand pillow blocks 201 and 202, respectively, which carry pivot shafts 203 and 204, respectively. The pivot shafts 203 and 204 pivotally support left hand and right hand upwardly extending support members 205 and 206, respectively. The support members 205 and 206 are pivotally movable toward and away from each other by means of pneumatic cylinders 207 and 208, respectively. Pneumatic cylinder 207 has one end pivotally connected by a pin 211 to the upper end of a lever 213 which has its lower end rigidly connected to shaft 203 as by clamped engagement. Pneumatic cylinder 207 has its other (rod) end pivotally connected to pin 204. Thus, when cylinder 207 is extended, support member 205 moves counterclockwise and when cylinder 207 is retracted, support member 205 moves clockwise.

Pneumatic cylinder 208 has one end pivotally connected by a pin 211A to the upper end of a lever 213A which has its lower end rigidly connected to shaft 204 as by clamped engagement. Pneumatic cylinder 208 has its other (rod) end pivotally connected to pin 203. Thus, when cylinder 208 is extended, support member 206 moves clockwise and when cylinder is retracted, support member 206 moves counterclockwise.

The upper portions of the support members 205 and 206 are provided with curved surfaces. Support member 205 includes a first curved surface 220 and a second curved surface 221 which are offset from each other. Support member 206 includes a first curved surface 222 and a second curved surface 223 which are offset from each other. The curved surfaces 220, 221, 222, and 223, afford support for the curved guide plates 104, 105, 102 and 101, respectively, which are rigidly secured thereto as by welding. Support member 205 also rotatably supports cage roller 113, which is disposed below plate 220, and cage roller 114, which is disposed between plates 220 and 221. Support member 206 also rotatably supports cage roller 111, which is disposed below plate 102, and cage roller 110, which is disposed between plates 101 and 102. Support member 205 has a lever 230 pivotally connected near the top end thereof by a pivot pin 231 and the cage roller 115 is pivotally supported on one end of lever 230 by a pivot pin 232. The other end of lever 230 is connected to support member 205 by a biasing mechanism 235 which operates to bias the roller 115 into engagement with a coil being formed on mandrel 100 but allows or enables cage roller 115 to assume different relative positions with respect to curved plate 105 as comparison of FIGS. 1 and 13 show.

Support member 206 has a lever 230A pivotally connected near the bottom end thereof by a pivot pin 231A and the cage roller 112 is pivotally supported on one end of lever 230A by a pivot pin 232A. Guide plate 103 is also supported on lever 230A. The other end of lever 230A is connected to support member 206 by a biasing mechanism 235A, in the form of a pneumatic cylinder 236, which operates to bias the roller 112 into engagement with (and guide plate 103 toward) a coil being formed on mandrel 100 but allows or enables cage roller 112 and guide plate 103 to assume different relative positions with respect to the mandrel as comparison of FIGS. 1 and 13 show. The rod end of cylinder 236 is connected to an end of lever 230A and the other end of the cylinder 236 is connected to a plate 237 which, in turn, is connected to support member 206.

The hold-down plates 106 and 107 hereinbefore referred to are mounted and arranged so as to be relatively movable with respect to each other and facilitate entry of the leading edge of the web W into the coiling mechanism 16. Hold-down plate 106 is rigidly secured to the upper end of support member 206 and is movable therewith. The hold-down plate 107 is rigidly secured to a lever arm 250 which in turn is rigidly connected as by clamping to a rotatable pivot shaft 251. Pivot shaft 251 is connected by a lever arm 252 by a pivot pin 253 to the rod end of a pneumatic cylinder 255. As comparison of FIG. 1 and FIG. 13 show, at the commencement of a coil winding operation, the hold-down plates 106 and 107 assume the position shown in FIG. 1 wherein they are relatively close to each other and define a triangular or funnel-like aperture through which the leading edge of the web is directed into the nip between cage roll 115 and mandrel 100. During the course of coil winding, however, the hold-down plates 106 and 107 are moved away from each other and perform no function and guide plate 107 is moved upwardly clear of the coil being formed.

The Coil Support Mechanism

Figure 12:
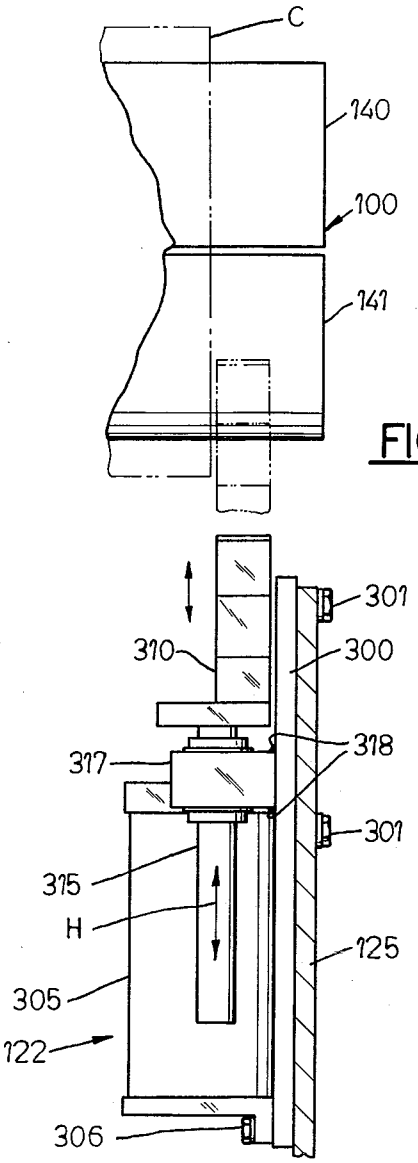
FIG. 12 is a view taken on line 12—12 of FIG. 11.

As FIGS. 9, 10, 11, and 12 show, the coil support mechanism 122 is mounted on the side support 125 of coiling mechanism 16 below the free end of the mandrel 100. The coil support mechanism 122 comprises a base plate 300 which is rigidly attached by bolts 301 to side plate 125. A pneumatic operating cylinder 305 is rigidly secured by bolts 306 to base plate 300 and the piston rod 308 of the pneumatic cylinder is reciprocably movable vertically as shown by arrow H (FIG. 12). Piston rod 308 is connected to and effects movement of a roll support member 310. Roll support member 310 has a curved upper surface 312 which generally conforms to the curvature of the mandrel 100. Member 310 is guided during vertical movement by means of a pair of downwardly extending guide rods 315 which are connected thereto and extend through openings 316 and a pair of sleeves 317 which are rigidly secured as by welding at 318 to base plate 300. When pneumatic cylinder 305 is extended, the member 310 moves upwardly into engagement with the underside of the outer end of mandrel 100. When a finished taped coil C is being ejected axially from mandrel 100, the coil support member 310 retracts. As will be noted from FIG. 9, the mandrel 100 and its main shaft 127 are supported only at the left end (with respect to FIG. 9) in a cantilever arrangement. Since the sheet material forming the coil is relatively heavy and as the coil increases in weight as it is being formed, it is desirable to employ the roll support mechanism 122 at the free end of the coil.

The Ejector Mechanism

As FIGS. 1, 2, 3, 9, and 13 show, coiling mechanism 16 includes an ejector mechanism 120 for axially shifting a wound and taped coil C off of mandrel 100 when the mandrel stops rotating and is retracted and the guide plates and cage rollers are moved radially away from the mandrel and coil thereon from their winding positions to their release positions. Ejector mechanism 120 comprises a support structure 350 which is rigidly mounted on apparatus framework F and, in particular, is mounted directly above mandrel 100, being supported on the side support 124 of the coiling mechanism 16. Frame 350 supports a pair of pulleys 351 and 352 which are spaced apart from each other and located at opposite ends of the framework. Frame 350 affords support for a carriage 355 which is reciprocably movable along the frame 350 in the direction of the arrow J (shown in FIG. 9) by means of cables 360 and 361. One end of cable 360, which is rigid around pulley 352, is attached to carriage 355 and the other end of cable 360 is attached to a piston 364 which is slideably mounted within a cylinder 365. One end of cable 361, which is reeved around pulley 351, is attached to carriage 355 and the other end of the cable is attached to piston 364. Cylinder 365 is rigidly mounted in fixed position on support frame 350. Carriage 355 includes a downwardly depending coil engagement member 367 which is adapted to engage an end of a coil C to shift the coil axially off of mandrel 100 as the carriage 355 is moved rightward (with respect to FIG. 9) by means of the cable 360 as the piston 364 is moved leftward (with respect to FIG. 9) when the right end of cylinder 365 is supplied with compressed air and pressurized to a greater pressure level than the left side of the cylinder. As will be understood, pressurization of the left side of cylinder 365 causes rightward movement of piston 364 and return of carriage 355 to the position shown in FIG. 9 after a coil C has been ejected from mandrel 100.

The Adhesive Tape Dispensing Mechanism

As FIGS. 1, 2, 6, 7, 8, 13, and 14 show, the adhesive tape dispensing and applying mechanism 18 is mounted on the apparatus framework F above and between the coiling mechanism 16 and the second web feed mechanism 14. Mechanism 18 comprises a rigid stationary support plate 260 which is secured in fixed position on framework F by bolts 261. A pneumatic operating cylinder 263 is mounted at the top of support plate 260 by means of a support bracket 265 which is connected to support plate 260 by a bolt 266. Pneumatic cylinder 263 comprises piston rod 267 which is reciprocably movable vertically and connected to lower and raise a carriage plate 262 which is mounted for sliding vertical reciprocating movement on support plate 260.

A horizontally extending tape roll support member 270 is mounted on and movable with carriage plate 262 and carries an axle or pin 271 which has a roll R of adhesive tape T rotatably mounted thereon. Roll R is mounted for free rotation on pin 271. Sensing means are provided to determine when tape roll R is exhausted and include a lever arm 274 which is pivotally mounted on roll support member 270 by a pin 275 and biased into engagement with roll R by a spring 278 connected between lever arm 274 and support member 270. Lever arm 274 carries an adjustable screw 280 which engages the toggle 281 of a limit switch TS2 (see FIG. 16) which is mounted by means of a bracket 283 on support member 270. Exhaustion of roll R effects actuation of limit switch TS2 to stop the apparatus.

Carriage plate 262 also supports a pneumatic cylinder 400 which is rigidly secured to plate 262 by bolt 401 and a tape head 403 which is mounted for vertical reciprocal movement on plate 262. Tape head 403 is connected to the piston rod 405 of cylinder 400 and is movable thereby between the raised position shown in FIG. 6 and the lowered tape application position shown in FIGS. 7 and 8. Tape head 403 comprises a tape cutting blade 407 which is movable therewith and cooperates with a stationary tape cutting blade 408 which is rigidly mounted at the lower edge of carriage plate 262 to sever tape T which extends therebetween when tape head 403 is moved upwardly relative to carriage plate 262 by pneumatic cylinder 400. Tape head 403 also comprises a tape applicator block 410 which carries a pair of rollers 411 and 412 between which tape T is fed and guided into position along the underside 414 of block 410. Underside 414 is provided with a plurality of vacuum parts 415 which communicate with a vacuum chamber 416 in block 410 and serve to hold the tape T against the block. Chamber 416 is understood to be connected to a suitable vacuum source (not shown).

Mechanism 18 operates as follows when the apparatus shown in FIG. 1 is in operation. While mandrel 100 is rotating, and a coil C is being formed thereon and after shear mechanism 12 has severed the web W, the pneumatic cylinder 263 operates to cause carriage plate 262 to descend from the position shown in FIGS. 1 and 6 to the position shown in FIGS. 7 and 8. As this occurs, the portion of the tape T lying against the undersurface 414 of block 410 strikes the trailing portion of the web W (i.e., the tail end of the coil), adheres thereto, and the tape T is drawn around roller 411 from the tape roll R. As the winding of the coil is completed, and a sufficient length of tape T has been wound therearound, the pneumatic cylinder 400 is actuated to retract the tape end 403 and as this occurs, the movable tape cutting blade 407 is drawn upwardly alongside the stationary tape cutting blade 408 and the tape T is severed. The retracted position of tape head 403 is shown in in FIG. 7. After tape severance, pneumatic cylinder 263 is actuated to retract the carriage to the position shown in FIGS. 1 and 6 and the pneumatic cylinder 400 is actuated to re-extend the tape head 403 to the position shown in FIGS. 1 and 6 and the tape dispensing and applying mechanism is in readiness for the next cycle of operation.

The Control Means

FIG. 16 is an electrical circuit diagram of a portion of the control system for the apparatus in accordance with the invention. The control system effects operation of the apparatus mechanism and components thereof in accordance with the graph shown in FIG. 15, which depicts one complete cycle of operation wherein one coil is wound, taped, and ejected. As FIG. 16 shows, the control system comprises an electrical power supply source including supply lines L1, L2, and L3 from which main motor M is energizable by means of a motor contactor MC after a disconnect switch DS is closed. Supply lines L1 and L2 also energize, through disconnect switch DS, a step-down transformer CPT which has output leads OL1 and OL2 connected to the output winding thereof. The leads OL1 and OL2 supply operating power through various control switches and limit switches hereinafter described to operating relays and solenoid coils which effect operation of main motor M, clutches, and pneumatic cylinders to cause operation of the apparatus as hereinbefore described and as shown in the graph in FIG. 15. As FIG. 16 shows, motor contactor MC for main motor M is controlled by main motor control relay MR which has one side connected to supply line OL2 and its other side connected through appropriate starting switches and normally closed stop and limit switches to supply line OL1. The circuit shown in FIG. 16 contains eight solenoids which effect control as follows. Solenoid 1S is energized to engage the feed roll clutch 30. Solenoid 2S is energizable to actuate the pneumatic cylinders 235A which controls the position of the bottom cage roll 112. Solenoid 3S is actuatable to operate the hold-down cylinders 255. Solenoid 4S is actuatable to control the pneumatic cylinders 263. Solenoid 5S is actuatable to control the pneumatic cylinder 365 of the ejector mechanism 120. Solenoid 6S is actuatable to control the pneumatic shear cylinder 73. Solenoid 7S is actuatable to control the rotation of the timer drum TD shown in FIG. 2. Solenoid 8S is actuatable to control the pneumatic cylinder 305 of the roll support mechanism 122. The circuit diagram in FIG. 16 also includes a measuring unit MU which receives an electrical input signal from a shaft encoder SE to control a relay CCR which controls the solenoid 7S for the timer drum TD and also controls energization of relay coils C1 and C2 which control a counter mechanism TDR. Measuring unit MU is adjustable to determine the length of web W which is to be cut off during coil formation and thus determines the size of the coil. In addition, the measuring unit MU, since it controls the timer drum TD by means of the solenoid 7S, also controls the timing and sequence of operation of the mechanisms and components thereof which comprise the apparatus.

I claim:

1. In a mechanism for forming a coil from a web of sheet material:

a rotatable expandable and contractable mandrel, said mandrel being expanded at the commencement of and during winding and being contractable after winding is completed;

a pair of adjustably positionable hold-down plates adjacent said mandrel and a plurality of web guide means including adjustably positionable guide plates disposed around the periphery of said mandrel, said web guide means having one position at the commencement of windind and while said mandrel is expanded for initially directing the incoming leading edge of a web of sheet material around and against said mandrel to enable commencement of coil winding, said web guide means being positionable away from said one position when coil winding commences;

and a plurality of adjustably positionable cage rollers disposed around the periphery of said mandrel for bearing against a coil being wound on said mandrel to ensure formation of a tight coil, said cage rollers being positionable out of engagement with said coil when coil winding is completed.

2. A mechanism according to claim 1 including coil support means disposed below said mandrel for supporting said mandrel as said coil is being wound.

3. A mechanism according to claim 1 including ejector means for axially moving a finished coil off of said mandrel when said mandrel is contracted and said web guide means and said cage rollers are positioned out of interfering relationship with said finished coil.

4. A mechanism according to claim 1 wherein each of said guide plates has one edge closer to said mandrel than the opposite edge.

5. In a mechanism for forming a coil from a web of sheet material:

a rotatable expandable and contractable mandrel, said mandrel being expanded at the commencement of and during winding and being contractable after winding is completed;

drive means for rotating said mandrel;

operating means for moving said mandrel between an expanded coil winding position and a contracted coil releasing position;

web guide means including a pair of adjustably positionable hold-down plates located adjacent said mandrel and a plurality of adjustably positionable guide plates disposed around the periphery of said mandrel;

means for supporting and positioning said hold-down plates and said guide plates between a web guide position near said mandrel while the latter is expanded for engaging and initially directing the incoming leading edge of said web of sheet material around said mandrel to enable the commencement of coil winding and a release position away from said mandrel and out of interfering relationship with a coil wound on said mandrel;

a plurality of adjustably positionable cage rollers disposed around a periphery of said mandrel;

and means for supporting and positioning said cage rollers between a position bearing against a coil being wound on said mandrel to ensure a tight coil and a release position away from said mandrel and out of interfering relationship with a coil on said mandrel.

6. A mechanism according to claim 5 wherein said hold-down plates are movable relative to each other and are moved close to each other when in said web guide position.

7. A mechanism according to claim 5 including a movable ejector means for axially moving a finished coil off of said mandrel when said mandrel is in contracted position and when said web guide means and said cage rollers are in the release positions;

and means for moving said ejector means.

8. A mechanism according to claim 5 including mandrel support means disposed below said mandrel as a coil is being wound.

9. A mechanism according to claim 5 wherein each of said guide plates has one edge closer to said mandrel than the opposite edge.

10. In a mechanism for forming a coil from a web of sheet material:

a rotatable expandable and contractable mandrel;

drive means for rotating said mandrel;

operating means for moving said mandrel between an expanded coil winding position at the commencement and during winding and a contracted coil releasing position after winding is completed;

web guide means including a plurality of adjustably positionable guide plates disposed around the periphery of said mandrel and further including a pair of relatively movable and adjustably positionable hold-down plates located adjacent the periphery of said mandrel;

positioning means for supporting and moving said guide plates and said hold-down plates to a web guide position near said mandrel prior to and during commencement of winding of a coil so that said plates engage and direct the leading edge of said web of sheet material around said mandrel and while the latter is expanded, said position means being further operable to move said web guide means to a release position away from said mandrel and out of interfering relationship with a coil being wound on said mandrel, said positioning means for said guide plates comprising a pair of relatively movable support members and motor means for moving said support members;

one of said support members serving as a means for supporting and moving one of said hold-down plates relative to the other and relative to said mandrel;

a plurality of adjustably positionable cage rollers disposed around a periphery of said mandrel;

and means for supporting and moving said cage rollers between a position wherein said cage rollers are bearing against a coil being wound on said mandrel to ensure a tight coil and a release position away from said mandrel and out of interfering relationship with a finished coil on said mandrel, said means for supporting and moving said cage rollers comprising said pair of relatively movable support members and said motor means.

11. A mechanism according to claim 10 wherein said mandrel comprises a rotatable main shaft, a pair of relatively movable sections mounted on said main shaft; and means connected to said pair of sections for moving at least one end of said sections toward and away from said main shaft.

12. A mechanism according to claim 11 wherein said means connected to said pair of sections includes a movable rod extending axially along said main shaft, a linkage connected between said rod and said pair of sections, and a motor for moving said rod.

13. A mechanism according to claim 10 including an ejector means for axially moving a finished coil off of said mandrel when said mandrel is in contracted release position and when said web guide means and said cage rollers are in the release positions;

and means for moving said ejector means.

14. A mechanism according to claim 10 including mandrel support means disposed below said mandrel for supporting said mandrel as a coil is being wound.

15. A mechanism according to claim 10 wherein each of said guide plates has one edge closer to said mandrel than the opposite edge.

* * * * *